US008491411B2

(12) United States Patent
DeShiell et al.

(10) Patent No.: US 8,491,411 B2
(45) **Date of Patent: *Jul. 23, 2013**

(54) GOLF-CLUB SHAFTS HAVING SELECTABLE-STIFFNESS TIP REGIONS, AND GOLF CLUBS COMPRISING SAME

(75) Inventors: Drew Tom DeShiell, Oceanside, CA (US); Todd P. Beach, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/218,268

(22) Filed: Aug. 25, 2011

(65) Prior Publication Data

US 2011/0312435 A1 Dec. 22, 2011

Related U.S. Application Data

(62) Division of application No. 12/054,186, filed on Mar. 24, 2008, now Pat. No. 8,029,382.

(51) Int. Cl.
*A63B 53/10* (2006.01)
*A63B 53/12* (2006.01)

(52) U.S. Cl.
USPC ..... 473/320; 473/307; 473/318

(58) Field of Classification Search
USPC ..... 473/316–323, 297, 312, 288, 307
See application file for complete search history.

(56) References Cited

U.S. PATENT DOCUMENTS

| | | | | |
|---|---|---|---|---|
| 4,319,750 | A * | 3/1982 | Roy | 473/320 |
| 4,836,545 | A * | 6/1989 | Pompa | 473/320 |
| 5,308,062 | A * | 5/1994 | Hogan | 473/292 |
| 5,439,219 | A * | 8/1995 | Vincent | 473/319 |
| 6,203,447 | B1 * | 3/2001 | Dillard | 473/316 |
| 6,343,999 | B1 * | 2/2002 | Murtland et al. | 473/289 |
| 6,719,645 | B2 * | 4/2004 | Kouno | 473/345 |
| RE38,983 | E * | 2/2006 | Antonious | 473/317 |
| 7,083,529 | B2 * | 8/2006 | Cackett et al. | 473/309 |
| 2002/0151378 | A1 * | 10/2002 | Tseng | 473/316 |
| 2006/0211510 | A1 * | 9/2006 | Ashida et al. | 473/316 |
| 2007/0026960 | A1 * | 2/2007 | Butler et al. | 473/316 |

FOREIGN PATENT DOCUMENTS

| | | | |
|---|---|---|---|
| JP | 11099230 | A * | 4/1999 |
| JP | 2004290391 | A * | 10/2004 |

* cited by examiner

*Primary Examiner* — Stephen L. Blau
(74) *Attorney, Agent, or Firm* — Klarquist Sparkman, LLP

(57) ABSTRACT

The subject golf clubs have a shaft and clubhead. The shaft has a tip-end coupled to the clubhead, a butt-end, a reduced-EI portion located adjacent the tip-end, and a remaining portion extending between the butt-end and the reduced-EI portion. The portions are coupled together at an interface. The remaining portion exhibits a respective rate of stiffness reduction as a function of distance from the butt-end. The reduced-EI portion is typically shorter than and has less stiffness than the remaining portion. The reduced-EI portion exhibits a respective rate (which can be zero) of stiffness reduction as a function of distance toward the tip-end. These rates can be similar or different. The interface can exhibit a greater rate in stiffness reduction than the other portions.

6 Claims, 13 Drawing Sheets

GOLF-CLUB SHAFTS HAVING SELECTABLE-STIFFNESS TIP REGIONS, AND GOLF CLUBS COMPRISING SAME

CROSS-REFERENCE TO RELATED APPLICATION

This application is a divisional of, and claims priority to and the benefit of, U.S. patent application Ser. No. 12/054,186, filed Mar. 24, 2008, now U.S. Pat. No. 8,029,382 incorporated herein by reference in its entirety.

FIELD

This disclosure is directed to, inter alia, golf-club shafts and golf clubs including same. More specifically, the disclosure is directed to golf-club shafts having an altered flexibility profile, particularly in the tip region, compared to conventional shafts and to such golf-club shafts of which the flexibility in the tip region can be manually changed.

BACKGROUND

Despite their various differences, all golf clubs share certain fundamental features: they all have a clubhead, a shaft, and a grip. The clubhead is configured for hitting the golf ball. The shaft is a pole connecting the clubhead to the grip. The shaft has a tip-end (lower end) that is attached to the clubhead and has a butt-end (upper end) onto which the grip is attached. During use of the club for play, the golfer holds onto the grip while executing a "swing" aimed at striking and propelling the ball forward.

Conventional shafts generally are tubular with a circular cross section that progressively decreases (tapers down or steps down) to provide a correspondingly progressive decrease in shaft stiffness from the butt-end to the tip-end. Conventional shaft materials include any of several suitable metals (e.g., steel) or composite materials. Composite shafts tend to have a different, usually "softer," feel than metal shafts, but tend to have lower mass than metal shafts. Composite materials usually are fibrous or filamentous materials reinforced with a cured synthetic resin. Most composite materials include some amount of carbon fiber ("graphite") or other suitable fiber impregnated in the resin.

The United States Golf Association (U.S.G.A.) currently has rules that limit certain aspects of golf-club shafts. For example, the shaft must be straight from the top of the grip to a point not more than five inches above the sole of the clubhead. Also, at any point along its length, the shaft must exhibit a deflection that is the same regardless of how the shaft is rotated about its longitudinal axis and must twist the same amount in both rotational directions (clockwise and counterclockwise around the longitudinal axis). These rules impose certain limitations on the configuration and permissible behavior of the shaft during play. For example, conforming shafts exhibit both dimensional and material symmetry (about their longitudinal axes) as well as symmetrical flexing behavior during actual play.

All golf-club shafts flex over their length during a swing. Shafts have a characteristic, termed "flexional rigidity," which at a location on the shaft is the product of Young's modulus (E) for the shaft material and second moment of area (I) of the section at that location. Normally, for shafts having a substantially cylindrical-tube shape, $I=\pi(D^4-d^4)/64$, where D is the external diameter and d is the internal diameter of the shaft at the location. In many types of clubs the flexional rigidity decreases substantially in a linear manner from the butt-end to the tip end of the shaft. Conventional shafts of metal-wood types of clubs have a flexional rigidity EI at the butt-end generally in the range of 50 to 180 $N\cdot m^2$, and at the tip-end about 10 to 30 $N\cdot m^2$.

In the quest to make golf more accessible and enjoyable to more players, attention has been given to altering the conventional configuration of golf clubs in the hope of making clubs more tailored to particular players and/or generally improving the performance of the clubs. For example, substantial effort has been directed to altering the distribution of discretionary mass in clubheads, altering the volume of clubheads, changing the material(s) of which the clubheads are made, and so forth.

One factor having a relationship to shaft flexibility, particularly of the shafts of metal-wood type clubs, is "dynamic loft." Each of the different golf clubs in a set of clubs has a specified "loft," which is the angle of the strike plate from a vertical plane when the clubhead is stationary at the address position relative to the ball. Thus, the club's stated loft provides the golfer with approximate information on the expected launch angle of a ball hit by the club. However, a club's loft number is simply a physical angle; other factors (in addition to the club's specified loft) contribute to the loft actually exhibited by the club during use, i.e., the dynamic loft or actual launch angle of the club. Dynamic loft affects, in turn, the flight of the ball, including flight distance.

Another factor related to shaft flexibility is "droop," which is the deflection of the shaft, in the toe-down direction, perpendicular to the swing plane at the moment of impact with the ball.

A key determinant of dynamic loft, droop, and certain other behaviors exhibited by a clubhead during play is the flexibility of the shaft. As the golfer executes a swing, the clubhead accelerates from zero to high velocity (e.g., up to 80-100 mph) in a fraction of a second while sweeping radially in a substantially full-circular path as a result of force applied by the golfer to the grip. Hence, the shaft naturally flexes during the swing. The flexure results in changes in the orientation of the clubhead relative to the shaft (and to the ball) at the moment of impact, compared to a clubhead that is stationary adjacent the ball. The multi-variate effects of shaft flexibility can be complex and difficult to predict and model.

Some past development effort, aimed at improving club performance, has been directed to the shafts of golf clubs. For example, various attempts have been made to alter the EI profile in one or more selected regions of the shaft, i.e., to depart significantly from the normally substantially uniform rate of increase in flexibility down the length of the shaft. In this regard, U.S. Pat. No. 4,319,750 discusses composite shafts having increased flexibility in the butt-end region of the shaft, in the region of the grip. U.S. Pat. No. 5,439,219 discusses shafts having increased flexibility in a zone situated just downstream of the butt-end region, namely just below the grip. U.S. Pat. No. 7,070,512 discusses, with respect to certain wood-type clubs, shafts having increased flexibility (decreased stiffness) in a zone located upstream of the tip-end. The subject clubs have stated lofts ranging from 14 to 18 degrees. The low-stiffness zones have EI values of 5-10 $N\cdot m^2$, and the shafts preferably include a small region of increased stiffness between the increased-flexibility zone and the clubhead. In other words, the rigidity of the shafts increases from the low-stiffness zone both toward the clubhead and toward the butt-end.

In view of the large influence of subjective criteria, categorically termed "feel," in the use of golf equipment, the various shaft-flexibility alterations noted in these references may be acceptable to certain golfers for certain golfing situations. But, for other golfers and/or other golfing situations, the alterations are not acceptable or effective.

Other factors affecting dynamic loft include prevailing weather conditions (wind, moisture, temperature), peculiarities of the golfer's swing, the spin imparted to the ball as struck by the club, and the particular golf course being played upon. (Spin is also affected, in turn, by the dynamic loft.) Since these factors are subject to change, it would be advantageous if the shaft flexibility of a particular club could be configured in a way that would yield a significant change in launch angle and ball spin. Pending a change in the relevant U.S.G.A. rules, it would also be advantageous if the flexibility of a region of the shaft of a particular club could be altered by the player in a way providing a degree of control over the effects of these factors. Certain advantages also could be realized if a club were provided having a shaft of which the local flexibility could be selectively manipulated for different golfer and/or to address situations arising during play.

SUMMARY

The foregoing and other needs are addressed by golf clubs as disclosed herein, of which various embodiments have a shaft comprising a first length region, a second length region, and a third length region. The first length region is the grip region (or "butt region"), the third length region is the tip region, and the second length region extends between the first and third length regions. The second length region has less stiffness than the first length region. The respective junctions between the first and second length regions and between the second and third length regions need not be abrupt. An "interface" is situated in the lower part of the second length region, in the upper part of the third length region, or in both parts. The lower part of the third length region is the tip-end to which a clubhead is mounted. A grip is normally mounted to the first length region.

In various embodiments at least one stiffener is engaged with, and coextensive with, the third length region up to at least the interface. The stiffener contributes stiffness to the shaft, particularly where the stiffener is located on the shaft.

The first and second length regions (or at least the second length region) desirably exhibit a respective progressive reduction in stiffness from the butt-end to the interface. A respective progressive reduction in stiffness is also exhibited from the interface to the tip-end. The respective rates of stiffness reduction, as a function of axial distance, in the shaft regions from the butt-end to the interface and from the interface to the tip-end, can be similar or different. The interface is a locus at which these respective rates of stiffness-reduction change from the respective rates from the first length region to the interface and from the interface to the tip-end. The locus can be either in the lower part of the second length region, in the upper part of the third length region, or in both parts. The respective shaft regions from the butt-end to the interface and from the interface to the tip-end can be made of similar or dissimilar materials. Also, the configurations (e.g., hollow versus solid) of the length regions can be similar or different.

The stiffener can be "internal" (situated inside the lumen of the shaft if the shaft is hollow) or "external" (situated outside the shaft in the manner of a sleeve or the like), or a combination thereof. Desirably, the stiffener is coaxial with the shaft. The stiffener desirably is detachable, allowing the golf club to be used without the stiffener, or with multiple different stiffeners. Since the region of the shaft from the interface to the tip-end exhibits reduced stiffness compared to other regions of the shaft, the golf club without the stiffener provides a shaft of which the shaft region from the interface to the tip-end exhibits minimal stiffness. By attaching a stiffener in at least this shaft region, the user effectively "adds back" stiffness to the shaft. The amount of stiffness added in this manner can vary, depending upon the stiffness of the stiffener and the manner in which the stiffener is attached to the shaft. In some instances, the stiffener can add sufficient stiffness to provide the shaft with an overall stiffness profile similar to a conventional golf club, in which the shaft has a substantially linearly progressive reduction of stiffness from the butt-end to the tip-end. In other instances, the stiffener adds a smaller or larger increment of stiffness.

In many embodiments (although not all embodiments), the clubhead is detachable from the tip-end of the shaft to facilitate attachment and detachment of stiffeners. In certain embodiments, attachment and detachment of the clubhead are performed using the same tool as used for attachment and detachment of the stiffener. In other embodiments, detaching the clubhead renders the stiffener removable without having to use a tool. This latter configuration can comprise a fastener (e.g., securing screw) that secures the clubhead to the shaft while simultaneously securing the stiffener to the shaft. In yet other embodiments the stiffener is attachable and detachable without having to remove the clubhead from the shaft.

In view of the above, it will be understood that a given golf club can include a "kit" of multiple stiffeners each providing a respective selective amount of "add-on" stiffness to the second length region. During practice or before commencing a round of golf, the golfer encountering a particular play situation selects a particular stiffener and attaches it to the shaft. If desired, multiple stiffeners can be used simultaneously, such as an internal stiffener and an external stiffener. Alternatively or in addition, a stiffener providing a particular stiffness can be selected and installed in a club at the point of sale, thereby providing a customized club for the purchasing customer. In this situation, the retailer can be provided with a kit of stiffeners and selects and installs a stiffener in a club according to the needs of the customer.

According to another aspect, golf clubs are provided that comprise a shaft including a butt-end, a tip-end, a length extending from the butt-end to the tip-end, and an interface at a location along the length. The length includes a major-length portion extending from the butt-end to the interface and a minor-length portion extending from the interface to the tip-end. The minor-length portion is shorter and has less stiffness than the major-length portion. A clubhead is mounted to the tip-end, and the butt-end includes a grip. The major-length portion exhibits, in a plot of stiffness (EI) versus distance from the butt-end to the interface, a substantially linearly progressive reduction in stiffness. This plot has a first slope. The minor-length portion exhibits, in a plot of stiffness (EI) versus distance from the interface to the tip-end, a substantially linearly progressive reduction in stiffness. This plot has a second slope, which can be substantially equal to the first slope. The interface comprises a juncture of the major-length and minor-length portions and exhibits a downward shift in stiffness, from the major-length portion to the minor-length portion, that is at a greater slope than the first slope. The lowest stiffness in the minor-length portion is 10 $N \cdot m^2$ or higher at the tip-end.

The foregoing and additional features and advantages of the invention will be more readily apparent from the following detailed description, which proceeds with reference to the accompanying drawings.

DETAILED DESCRIPTION

As used in this application and in the claims, the singular forms "a," "an," and "the" include the plural forms unless the context clearly dictates otherwise. Additionally, the term "includes" means "comprises." Further, the term "coupled" encompasses any of various ways in which items can be mechanically coupled or linked and does not exclude the presence of intermediate elements between the coupled items.

The described things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
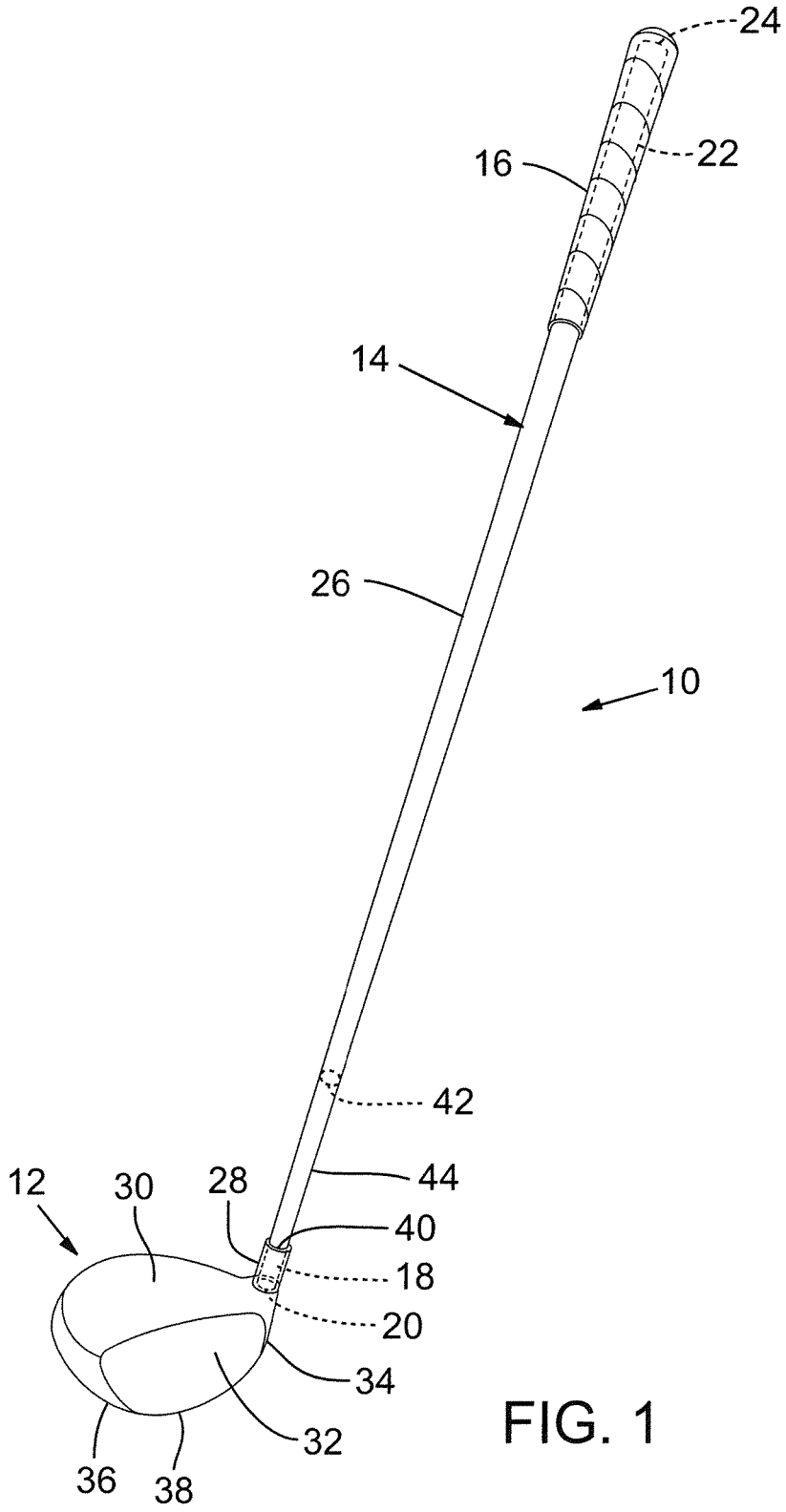
FIG. 1 is a perspective view of an embodiment of a golf club, of metal-wood type, comprising a shaft having a reduced-EI portion at the tip-end region.

An exemplary golf club 10 is shown in FIG. 1. The golf club 10 comprises a clubhead 12, a shaft 14, and a grip 16. By way of example, the clubhead 12 in the figure is that of a "metal-wood." The shaft 14 comprises a tip-end region 18, a tip-end 20, a butt-end region 22, a butt-end 24, and an intermediate region 26. The shaft 14 has a gradual taper from the butt-end region, also called "grip-end region," 22 (having the greatest diameter) to the tip-end region 18 (having the smallest diameter). The grip 16 is formed over or otherwise provided on the butt-end region 22. In most clubs, the tip-end 20 of the shaft 14 is inserted into a hosel 28 of the clubhead 12. In other clubs, the hosel 28 is eliminated, and the tip-end 20 simply extends into a receptacle (e.g., a bore), in the clubhead 12. The clubhead 12 also has a crown 30, a strike face 32, a heel 34, a toe 36, and a sole 38. Extending from the tip-end to a location 42 up the shaft 14 is a "reduced-EI portion" 44 as described below. The reduced-EI portion 44 is shorter than the remainder of the shaft 14, and hence the reduced-EI portion is termed the "minor-length" portion, while the remainder is termed the "major-length" portion.

In various embodiments of golf clubs, the clubhead 12 is configured as that of a driver, having a stated loft of 8.5 to 14 degrees. The lowest stiffness in the reduced-EI portion 42 is desirably 10 $N \cdot m^2$ or higher.

Figure 2:
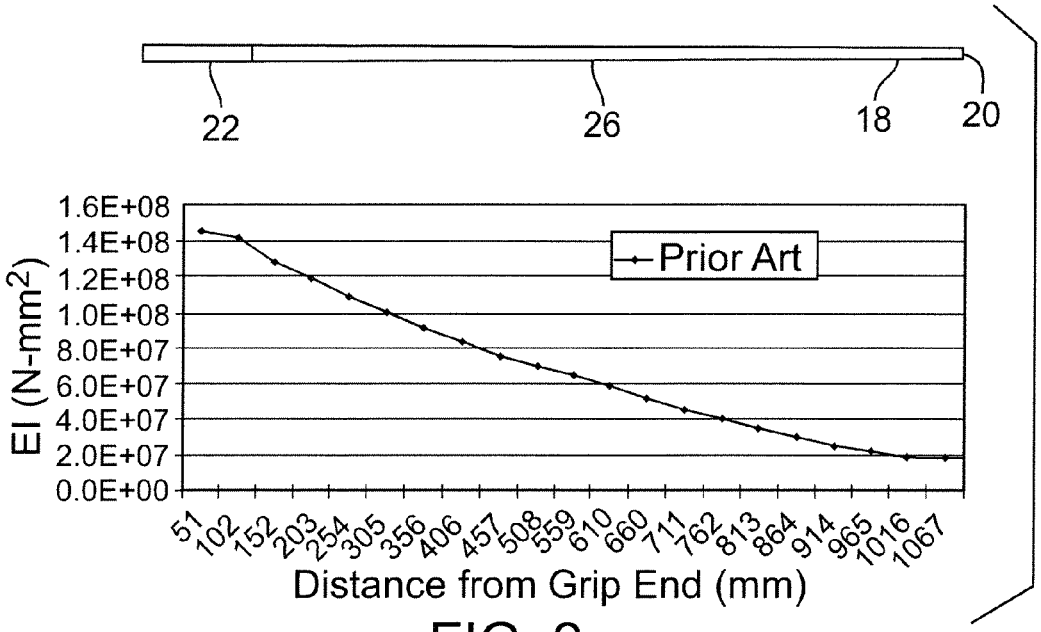
FIG. 2 PRIOR ART
FIG. 2 is a plot of stiffness (EI) versus distance from the butt-end to the tip-end of a conventional golf-club shaft.

In a first series of experiments Applicant tested two shafts of conventionally linear but offset flex profiles (representing a difference of several "labeled" flexes) with low-handicap players. I.e., each shaft had a respective greatest stiffness at the butt-end, had a respective least stiffness at the tip-end, and (in a plot of EI versus distance) exhibited a substantially linearly progressive reduction in stiffness from the butt-end to the tip-end. Such a stiffness profile is called a "conventional linear stiffness profile," and an example thereof is shown in FIG. 2. The upper portion of FIG. 2 depicts a conventional shaft, and the lower portion is the plot of stiffness. The clubs were evaluated with respect to their ability to produce particular launch conditions of a golf ball struck under controlled conditions. The results of the experiment indicated that dynamic loft is not significantly changed from one club to the next simply by offsetting the conventional linear stiffness profile. Calculations were then made to investigate the effect of "shifting" a conventional linear profile on the dynamic loft of a club.

Figure 3:
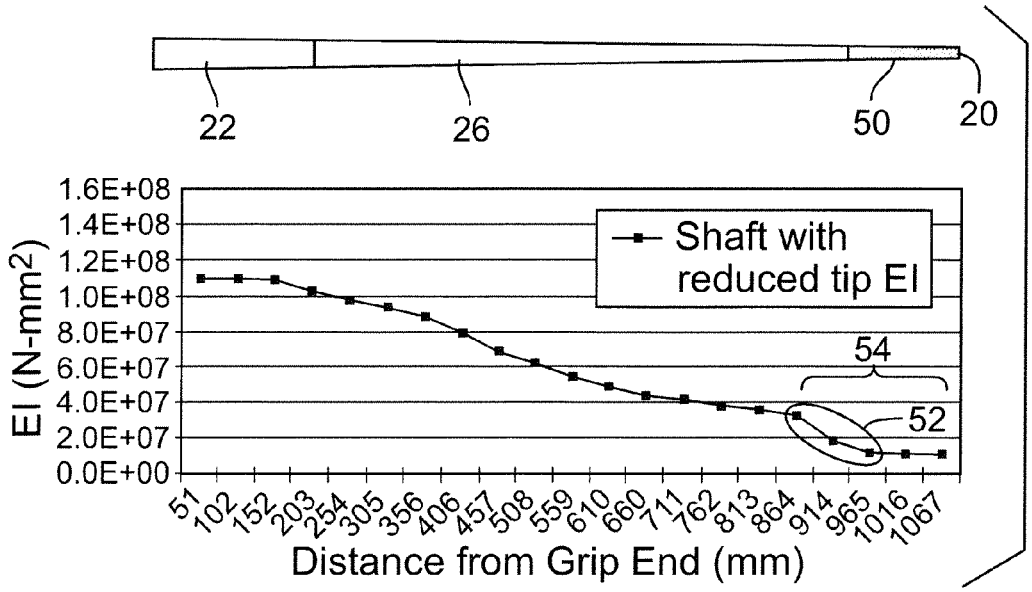
FIG. 3 is a plot of EI versus distance from the butt-end to the tip-end of an embodiment of a golf-club shaft comprising a reduced-EI portion that produces a significant downward shift of EI in the otherwise substantially linear plot.

In a second series of experiments Applicant tested golf clubs that were otherwise identical, but each had a respective "reduced-EI portion" in the shaft. An exemplary reduced-EI portion 50 is shown in FIG. 3, in which the upper portion of the figure depicts a shaft, and the lower portion is a plot of EI versus distance along the shaft. Beginning at the grip-end region 22, the plot shows a substantially linearly progressive reduction in stiffness over most of the shaft length. Note that the slope is substantially constant over this region, which represents most of the length of the shaft and hence is termed the "major-length" portion. At about 914 mm in this example, a reduced-EI portion 50 begins. The reduced-EI portion 50 is shorter than the major-length portion and hence is termed the "minor-length" portion. In the corresponding plot, the reduced-EI portion 50 (see region 54) shows a corresponding significant departure (dip or downward shift in region 52) in stiffness compared to the slope exhibited by the major-length portion. After the dip 52 (rightward in the plot), the stiffness of the minor-length portion maintains a nearly constant value to the tip-end. Hence, in the example of FIG. 3, shaft stiffness decreases at a substantially uniform rate (substantially linearly progressive reduction in stiffness from left to right) over the distance 100-880 mm. The dip 52 is from about 880 mm to about 960 mm, and the region 54 starts at about 880 mm and continues to the tip-end 20 of the shaft (approximately 1075 mm). Note that the region from about 960 mm to the tip-end 20 has substantially the same value.

In addition to the second series of experiments, a large number of calculations were made to determine the effects of differences in length of the reduced-EI portion from the tip-end (length of reduced-EI portion varying from 0-19 inches or 0-483 mm), and differences in percent of reduction of stiffness in the reduced-EI portion relative to the shaft stiffness at the point at which the reduced-EI portion begins (range of 10-80%). Results are tabulated in Table 1 and plotted in FIG. 4. In Table 1 the tabulated values are of change in dynamic loft (degrees) relative to an otherwise similar club with a conventional shaft profile. Also, predicted loft-angle changes for offsetting one or two "labeled flexes" are shown in the last two columns.

TABLE 1

| Reduced-EI Part | | | | | | | | | | One- | Two- |
|---|---|---|---|---|---|---|---|---|---|---|---|
| Length | Length | Percent Reduction in Stiffness in Reduced-EI Portion | | | | | | | | shaft | shaft |
| (in) | (mm) | 10% | 20% | 30% | 40% | 50% | 60% | 70% | 80% | flex | flex |
| 0 | 0 | 0.01 | 0.03 | 0.05 | 0.08 | 0.12 | 0.18 | 0.27 | 0.44 | 0.26 | 0.38 |
| 1 | 25 | 0.03 | 0.08 | 0.13 | 0.20 | 0.31 | 0.44 | 0.67 | 1.06 | 0.26 | 0.38 |
| 2 | 51 | 0.06 | 0.14 | 0.23 | 0.34 | 0.51 | 0.74 | 1.08 | 1.63 | 0.26 | 0.38 |
| 3 | 76 | 0.07 | 0.17 | 0.28 | 0.41 | 0.62 | 0.87 | 1.26 | 1.86 | 0.26 | 0.38 |
| 4 | 102 | 0.09 | 0.20 | 0.34 | 0.49 | 0.73 | 1.01 | 1.44 | 2.05 | 0.26 | 0.38 |
| 5 | 127 | 0.10 | 0.22 | 0.36 | 0.53 | 0.77 | 1.07 | 1.50 | 2.11 | 0.26 | 0.38 |
| 6 | 152 | 0.10 | 0.23 | 0.39 | 0.56 | 0.82 | 1.12 | 1.55 | 2.16 | 0.26 | 0.38 |
| 8 | 203 | 0.11 | 0.25 | 0.41 | 0.60 | 0.85 | 1.16 | 1.59 | 2.19 | 0.26 | 0.38 |
| 10 | 254 | 0.12 | 0.26 | 0.42 | 0.61 | 0.87 | 1.18 | 1.61 | 2.20 | 0.26 | 0.38 |
| 12 | 305 | 0.12 | 0.26 | 0.43 | 0.62 | 0.88 | 1.19 | 1.62 | 2.21 | 0.26 | 0.38 |
| 14 | 356 | 0.12 | 0.27 | 0.44 | 0.63 | 0.89 | 1.20 | 1.62 | 2.21 | 0.26 | 0.38 |
| 19 | 483 | 0.12 | 0.27 | 0.44 | 0.63 | 0.90 | 1.20 | 1.63 | 2.22 | 0.26 | 0.38 |

Figure 4:
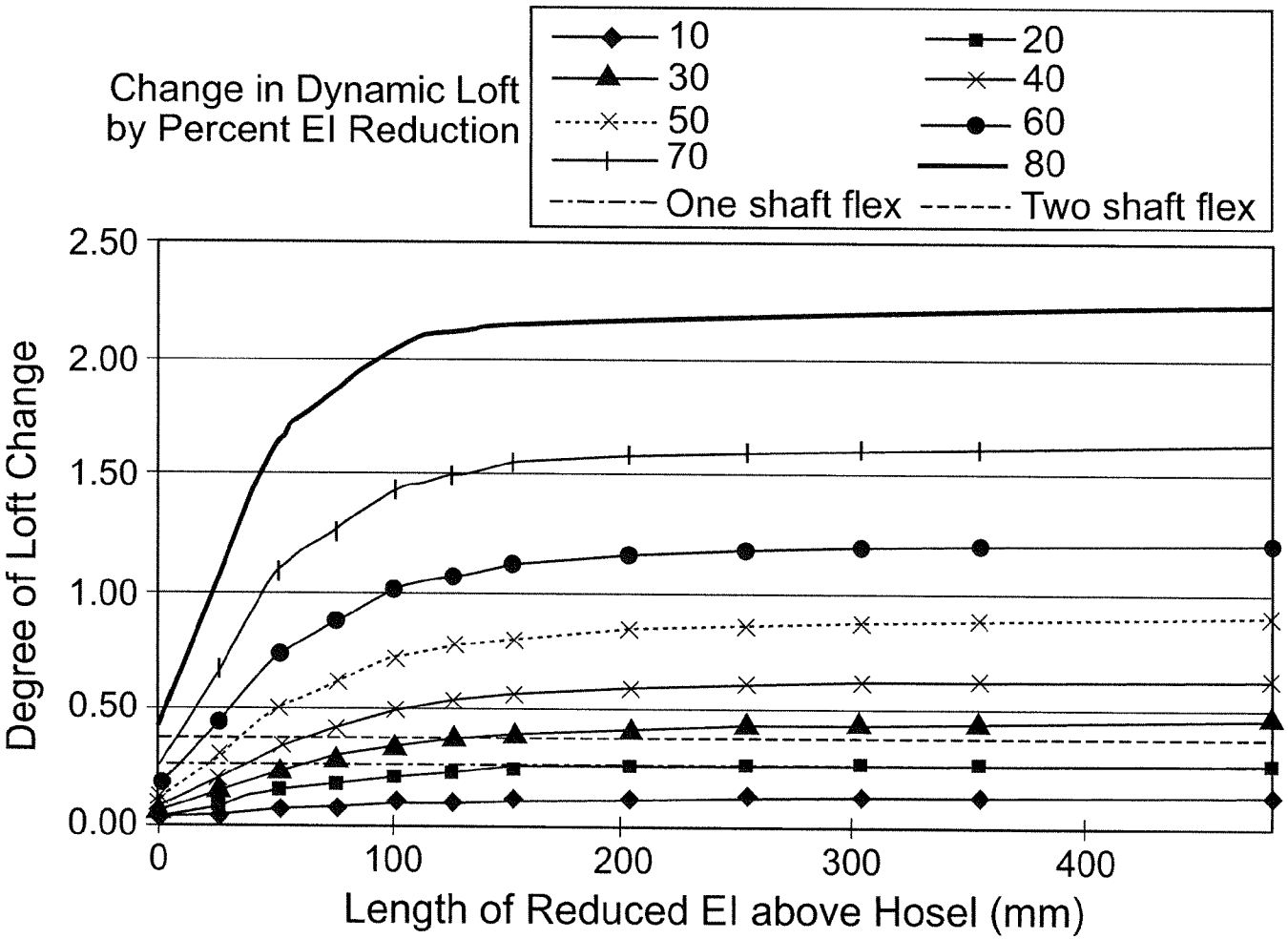
FIG. 4 is a plot of multiple curves predicted from calculations for golf-club shafts in which, from the upper-most curve to the lowest curve, the reduced-EI portions exhibit a 80%, 70%, 60%, 50%, 40%, 30%, 20%, and 10% reduction, respectively, in stiffness. The two horizontal-line plots are of change in dynamic loft predicted by respective changes in shaft flex, one flex X to S-flex, and two flexes X to R-flex.

In FIG. 4 the uppermost curve is of data for shafts in which the reduced-EI portion exhibits an 80% reduction in stiffness, and the lowermost curve is of data for shafts in which the reduced-EI portion exhibits a 10% reduction in stiffness. The intermediate curves are of data for shafts in which the reduced-EI portion exhibits a 70%, 60%, 50%, 40%, 30%, and 20% reduction, respectively, in stiffness. The two horizontal lines are predicted changes in dynamic loft angle for offsetting one or two "labeled flexes." The plots become substantially horizontal at reduced-EI portion lengths greater than 200 mm (about 8 inches) from the tip-end (above the hosel). In the length range of 150-200 mm the plots begin to reveal significant increases in slope. In the range 100-150 mm the slopes increase further, and in the range 0-100 mm the slopes are greatest. Thus, the largest effect on change in dynamic loft is realized with shorter reduced-EI portions such as 8 inches or less, 6 inches or less, or 4 inches or less, from the tip-end.

First Embodiment

Figure 5:
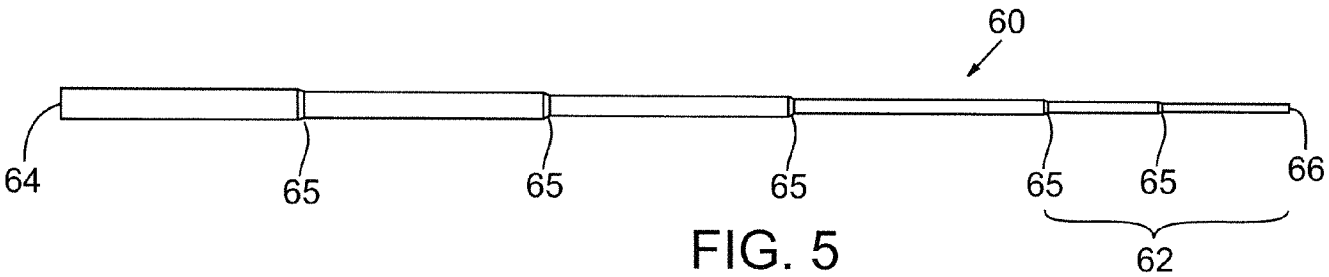
FIG. 5 depicts a golf-club shaft, according to the first embodiment, comprising a reduced-EI portion adjacent the tip-end and having progressive step reductions in outside diameter from the butt-end to the reduced-EI portion and continuing into the reduced-EI portion.

A first embodiment of a golf-club shaft 60 comprising a reduced-EI portion 62 adjacent the tip-end 66 is shown in FIG. 5. The depicted shaft 60 has a shape with progressive step reductions 65 in outside diameter of the shaft from the butt-end 64 to the tip-end 66. Any of various conventional shaft materials, including but not limited to steel and composite, can be used to fabricate the shaft 60. In this embodiment the step reductions 65 continue closer to the tip-end 66 than conventionally, and the tip-end has less outside diameter than conventionally. Whereas a conventional outside diameter at the tip-end 66 is 0.350 or 0.335 inch for a metal-wood shaft, the stepped configuration in this embodiment is continued toward the tip-end 66 more than conventionally to produce a diameter at the tip-end that is less than conventional (e.g., 0.300 inch or less), resulting in the desired reduction in stiffness in the reduced-EI portion 62.

Figure 6:
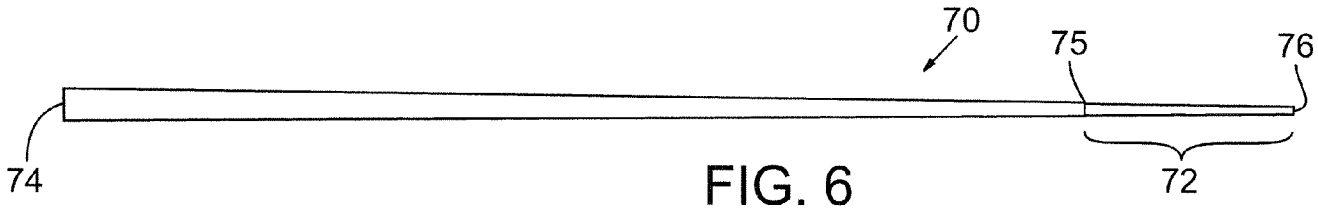
FIG. 6 depicts a golf-club shaft, according to an alternative to the first embodiment, having a continuously progressive reduction in outside diameter from the butt-end to the reduced-EI portion. The reduced-EI portion can be made of the same material as the remainder of the shaft or of a different material.

In an alternative configuration of this embodiment, shown in FIG. 6, the shaft 70 is formed to have an outside diameter that progressively tapers from the butt-end 74 over most of the length of the shaft toward the tip end 76, but has at least one stepped reduction 75 at or near the beginning of the reduced-EI portion 72.

Second Embodiment

Figure 7:
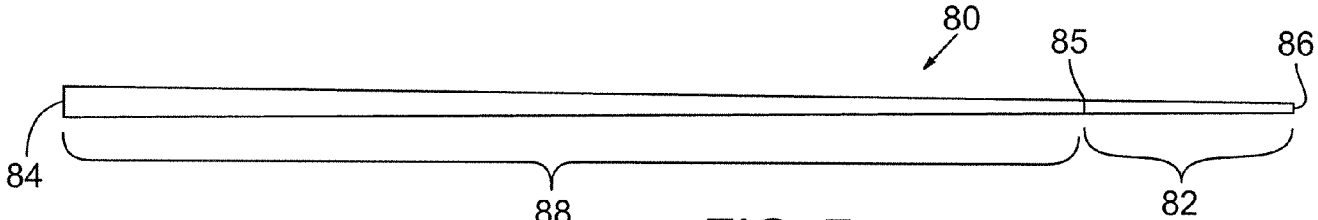
FIG. 7 depicts a golf-club shaft, according to the second embodiment, in which the reduced-EI portion is made of material having lower stiffness than the material of the remainder of the shaft, or the reduced-EI portion is made of a similar material but with different orientation, modulus, or other characteristic than the material of the remainder of the shaft.

A second embodiment of a golf-club shaft 80 comprising a reduced-EI portion 82 at the tip end 86 is shown in FIG. 7. The opposite end of the shaft 80 is the butt-end 84. In this embodiment, instead of the shaft 80 being of the same material unit throughout, the reduced-EI portion 82 is of a material having a lower stiffness or a different orientation, in the case of a composite, than the material of the remaining portion 88 of the shaft. For example, if the remaining portion 88 is of a particular type of steel, exemplary materials for the reduced-EI portion 82 are another type of steel, an aluminum alloy, magnesium, graphite, fiberglass, and plastic. Hence, the remaining portion 88 can be of a first metal, and the reduced-EI portion 82 can be of a different metal. Alternatively, the remaining portion 88 can be of a metal, and the reduced-EI portion can be of a composite material, or vice versa. Further alternatively, the remaining portion 88 can be of one composite (e.g., carbon-fiber composite), and the reduced-EI portion 82 can be of another composite (e.g., Kevlar-fiber composite) or of a similar composite but having a different fiber orientation, modulus, or other characteristic. Further alternatively, the remaining portion 88 and reduced-EI portion 82 can be made of similar materials (e.g., steel or composite), but with different configurational features (e.g., outside diameter, wall thickness, inside diameter, presence or absence of internal ribs, fiber orientation, modulus, etc.)

The interface 85 of the reduced-EI portion 82 with the remaining portion 88 of the shaft can be a mechanical linkage (e.g., threaded, pin-in-socket, or the like), an adhesive bond, or combination thereof. The interface 85 can be abrupt, as suggested in FIG. 7, or formed as a gradual transition from one material to another, such as one metal to another metal, one composite to another composite, a metal to a composite, or a composite to a metal. With an interface 85 involving at least one composite material, the interface can be formed as a region of interleaved or interdigitated plies of the composite with plies of a second composite, metal plies, or the like. If its use is necessary, the adhesive used in the interface 85 would be selected based upon the particular materials to be bonded together and the manner in which the portions 82, 88 are coupled together in the interface. For example, bonding of a composite such as graphite or fiberglass (as the reduced-EI portion 82) to steel (as the remaining portion 88) would require a specific adhesive (e.g., an epoxy adhesive) and surface preparation, as well as an appropriate joint geometry (e.g., overlap of respective materials).

An exemplary range of modulus for the materials is 10 MSI to 85 MSI. If composites are used, longitudinal stiffness can be manipulated by aligning the fibers of the composite differently in the regions 82, 88, e.g., off-axis. Since composite shafts typically are made of several discrete plies of fibers, the interface 85 can include overlapped plies, as noted above.

Figure 8:
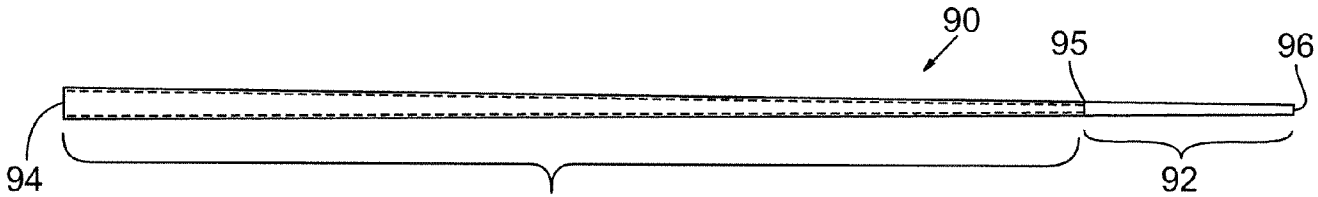
FIG. 8 depicts a golf-club shaft, according to the third embodiment, in which the reduced-EI portion is made of a solid material, and the remainder of the shaft is made of a hollow material. The materials can be the same or different.
Figure 8A:
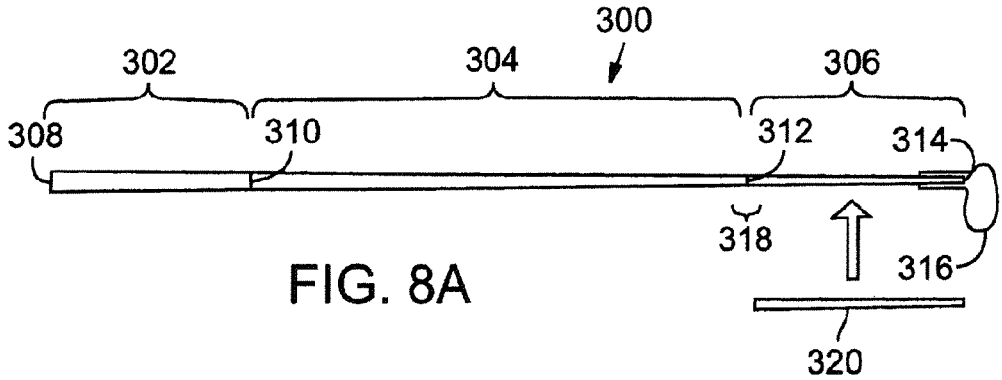
FIG. 8A depicts a shaft configuration including first, second, and third length regions, wherein the third length region is a reduced-EI region, and an interface zone in the vicinity of the junction of the second and third length regions.

FIG. 8A depicts a shaft configuration 300 including a first length region 302, a second length region 304, and a third length region 306, the latter being a reduced-EI portion. The first length region is a grip region including a butt-end 308, and the third length region 306 is a tip region including a tip-end 314. Also shown are a junction 310 of the first and second length regions, a junction 312 of the second and third length regions, a clubhead 316, and an interface zone 318 in the vicinity of the junction 312. The second length region 304 extends between the first and third length regions and has less stiffness than the first length region 302. The interface zone 318 is located at or near a juncture of the second and third length regions. The clubhead 316 is attached to the tip-end 314. A separately attachable stiffener 320 extends over at least the third length region 306 to add stiffness to at least the third length region.

Figure 8B:
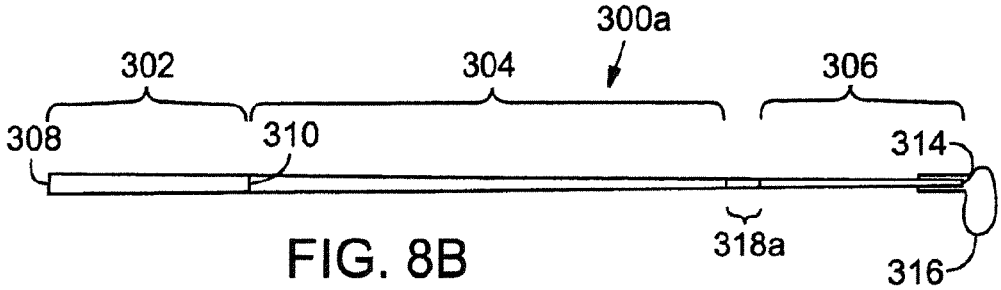
FIG. 8B depicts a variation of the FIG. 8A configuration in which the interface zone is situated between the second and third length regions.

FIG. 8B depicts a variation 300*a* of the FIG. 8A configuration in which the interface zone 318*a* is situated between the second length region 304 and third length region 306.

Figure 8C:
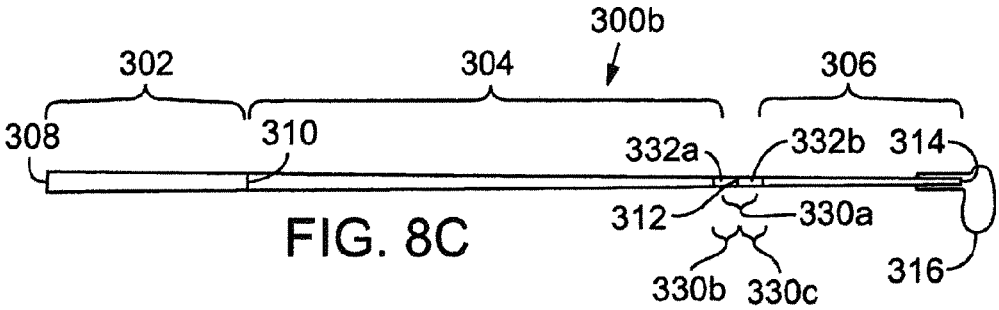
FIG. 8C depicts a variation of the FIG. 8A configuration in which the interface zone includes a respective portion of at least one of the second length region and third length region.

FIG. 8C depicts a variation 300*b* of the FIG. 8A configuration in which the interface zone 330 includes a respective portion of at least one of the second length region 304 and the third length region 306. Specifically, the interface zone 330*a* includes portions 332*a*, 332*b* of both regions 304, 306, respectively; alternatively, the interface zone 330*b* include portion 332*a* of the second length region 304; and further alternatively, the interface zone 330*c* includes portion 332*b* of the third length region 306.

Figure 8D:
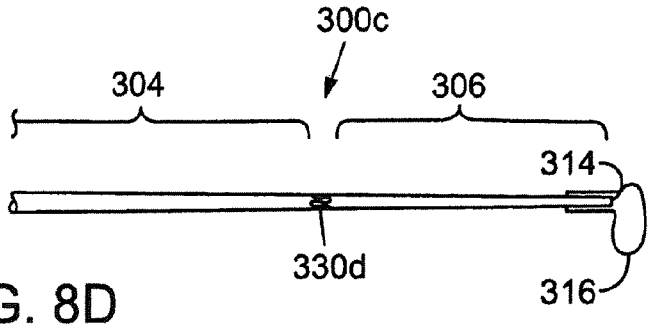
FIG. 8D depicts a variation of the FIG. 8A configuration in which the interface zone is a locus in which the second length region transitions to the third length region.

FIG. 8D depicts a variation 300*c* of the FIG. 8A configuration in which the interface zone 330*d* (shown with interdigitation by way of example) is a locus in which the second length region 304 transitions to the third length region 306. Only the second and third length regions of the subject shaft 300*c* are shown in this figure.

Figure 8E:
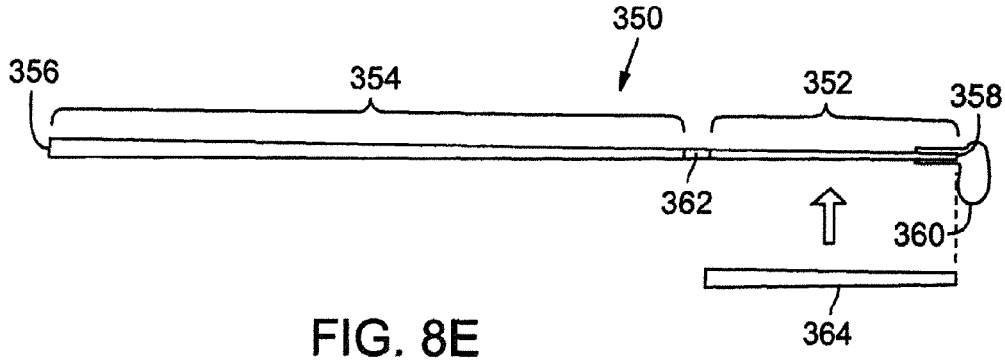
FIG. 8E depicts a shaft configuration including a reduced-EI portion, a remaining portion, and an attachable stiffener for at least the reduced-EI portion.

FIG. 8E depicts a shaft configuration 350 including a reduced-EI portion 352 and a remaining portion 354. Also shown are the butt-end 356, the tip-end 358, and the clubhead 360 attached to the tip-end. The remaining portion 354 extends from the butt-end 356 to the reduced-EI portion 352. The remaining portion 354 and the reduced-EI portion are coupled together in an interface zone 362. Also shown is an attachable stiffener 364 for at least the reduced-EI portion 352.

Figure 8F:
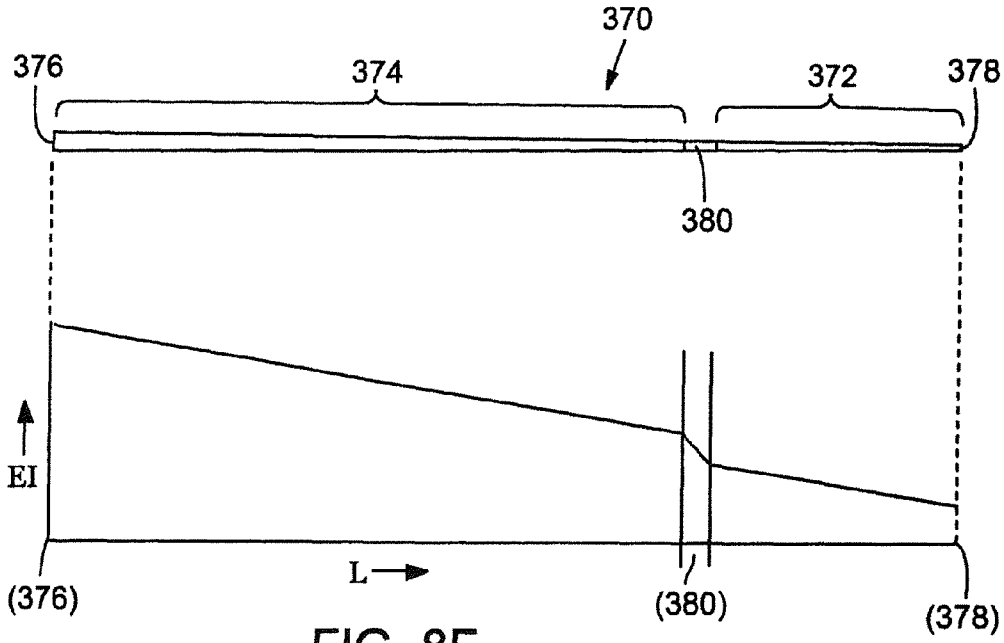
FIG. 8F depicts a shaft configuration including a reduced-EI portion, a remaining portion, and an interface zone. The associated graph shows that the remaining portion exhibits a substantially uniform rate of stiffness reduction as a function of distance from the butt-end to the reduced-EI portion, and the interface zone exhibits a greater rate of stiffness reduction, as a function of distance, than exhibited by the remaining portion.

FIG. 8F depicts a shaft configuration 370 including a reduced-EI portion 372 and a remaining portion 374. Also shown are the butt-end 376, a tip-end 378, and an interface zone 380. As seen in the associated graph, the remaining portion exhibits a substantially uniform rate of stiffness reduction as a function of distance from the butt-end 376 to the reduced-EI portion 372. Also, the interface zone 380 exhibits a greater rate of stiffness reduction, as a function of distance, than exhibited by the remaining portion 374. The graph in FIG. 8F also shows that the reduced-EI portion 372 exhibits a rate of stiffness reduction, as a function of distance from the interface zone 380 to the tip-end 378, that is substantially the same as exhibited by the remaining portion 374.

Figure 8G:
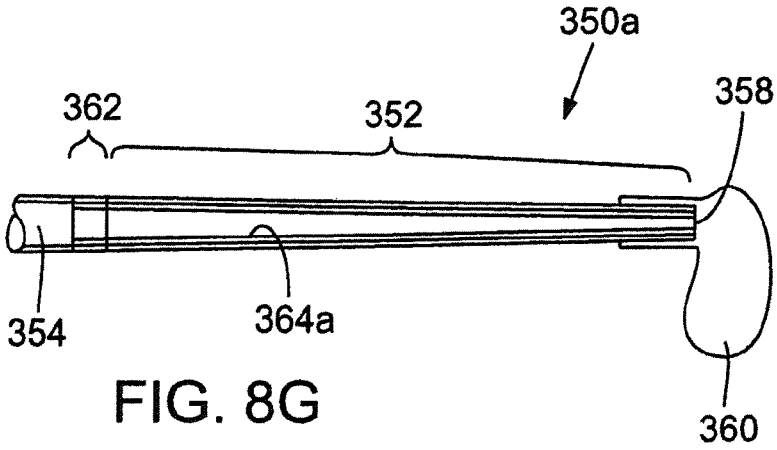
FIG. 8G depicts the narrower end of a shaft that is similar to the shaft shown in FIG. 8E, but in which the stiffener is an internal stiffener.

FIG. 8G depicts the narrower end of a shaft 350*a* that is similar to the shaft 350 shown in FIG. 8E, but in which the stiffener is an internal stiffener 364*a*. In this example, the stiffener 364*a* extends substantially from the tip-end 358 to the interface zone 362 between the reduced-EI portion 352 and the remaining portion 354.

Figure 8H:
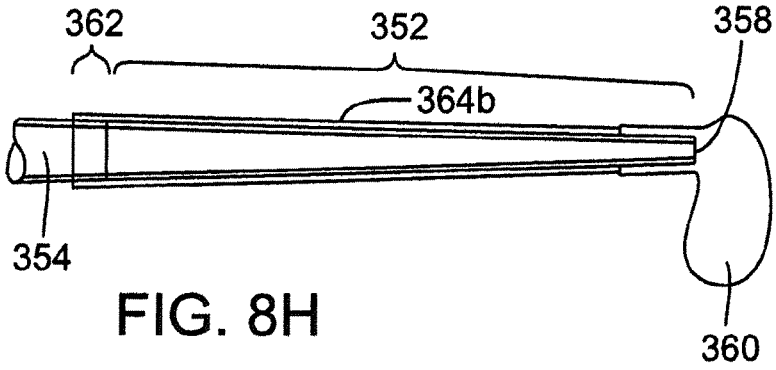
FIG. 8H depicts the narrower end of a shaft that is similar to the shaft shown in FIG. 8E, but in which the stiffener is an external stiffener.

FIG. 8H depicts the narrower end of a shaft 350*b* that is similar to the shaft 350 shown in FIG. 8E, but in which the stiffener is an external stiffener 364*b*. In this example, the stiffener 364*b* extends substantially from the tip-end 358 to the interface zone 362 between the reduced-EI portion 352 and the remaining portion 354.

Figure 8I:
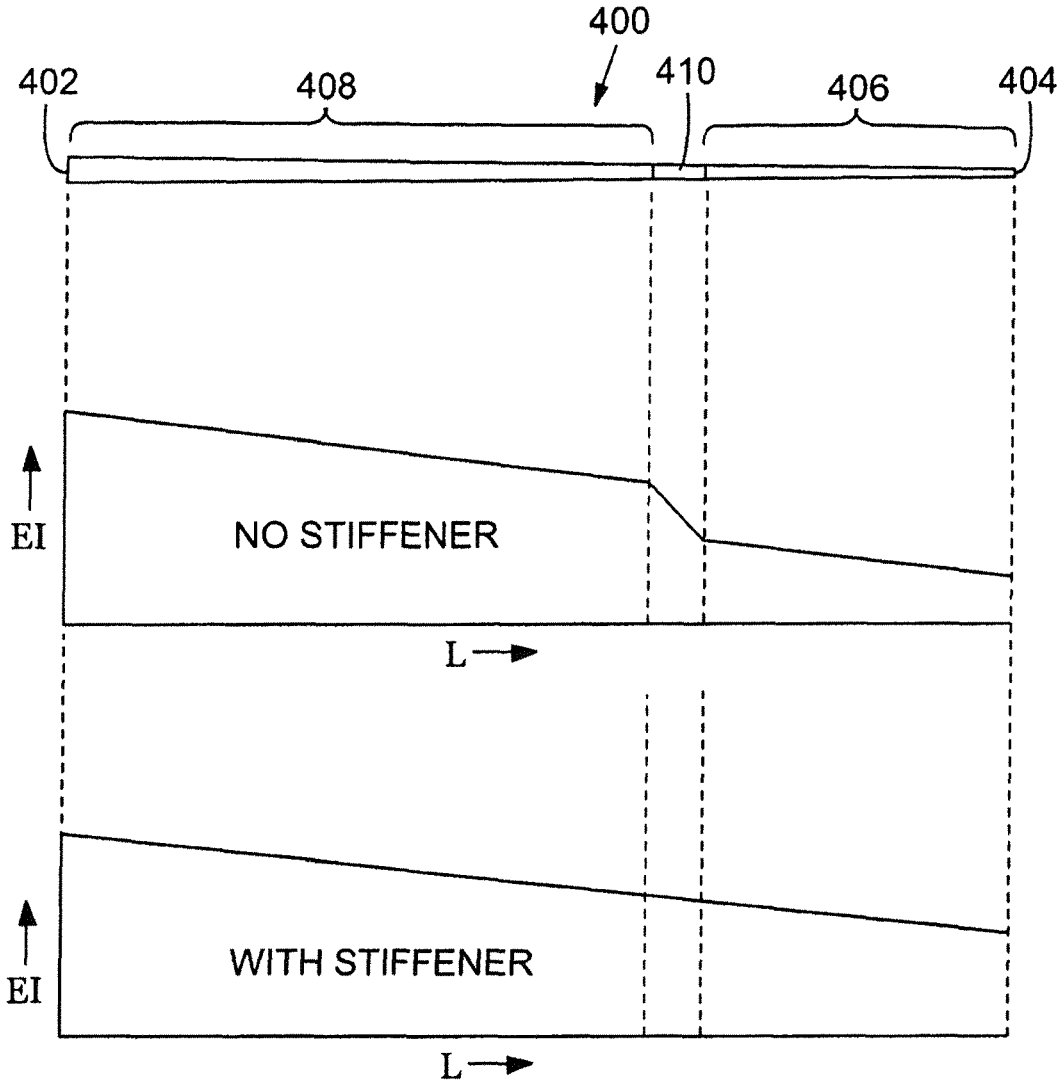
FIG. 8I depicts a situation in which a stiffener contributes stiffness to the reduced-EI portion such that the shaft with stiffener exhibits a substantially uniform rate of stiffness reduction as a function of distance (L) from the butt-end to the tip-end.

FIG. 8I depicts a situation in which a stiffener contributes stiffness to the reduced-EI portion such that the shaft with stiffener exhibits a substantially uniform rate of stiffness reduction as a function of distance (L) from the butt-end to the tip-end. Shown are the shaft 400 with butt-end 402, tip-end 404, reduced-EI portion 406, remaining portion 408, interface zone 410, graph of EI versus L for shaft with stiffener (upper graph), and graph of EI versus L for shaft without stiffener (lower graph).

Third Embodiment

A third embodiment of a golf-club shaft 90 comprising a reduced-EI portion 92 at the tip end 96 is shown in FIG. 8. The opposite end of the shaft 90 is the butt-end 94. In this embodiment, instead of the shaft 90 being hollow throughout its entire length, the reduced-EI portion 92 is solid and has lower stiffness than the remaining portion 98 of the shaft. The portions 92, 98 can be made of the same material or of different materials. For example, the portion 98 can be made of a first metal (e.g., a first type of steel) or first composite, and the reduced-EI portion 92 can be made of a second metal (e.g., a second type of steel, such as "memory wire") or a second composite, respectively. In another example, the reduced-EI portion 92 is made of a metal (e.g., steel or stainless steel) while the remaining portion 98 is made of a composite material. In yet another example, the reduced-EI portion is made of a composite material while the remaining portion 98 is made of a metal (e.g., steel or stainless steel). The remaining portion 98 can be configured as described in, for example, the first embodiment, with stepped reductions in outside diameter or a tapered configuration. As in the first and second embodiments, exemplary materials for making the shaft 90 are steel, stainless steel, aluminum alloy, magnesium, graphite composite, fiberglass composite, other composite, and plastic (desirably reinforced using, for example, glass fibers). The reduced-EI portion 92 is bonded to the remaining portion 98 at an interface 95, which can be abrupt or gradual. Bonding can be achieved by conventional bonding methods, which would depend upon the particular materials involved (see second embodiment). Alternatively, a mechanical attachment method could be used, such as (but not limited to) swaging.

The reduced-EI portion 92 is typically less than half the full length of the shaft 90 and thus is shorter than the remaining portion 98. Representative lengths of the reduced-EI portion are 8 inches or less, 6 inches or less, or 4 inches or less.

Fourth Embodiment

Figure 9:
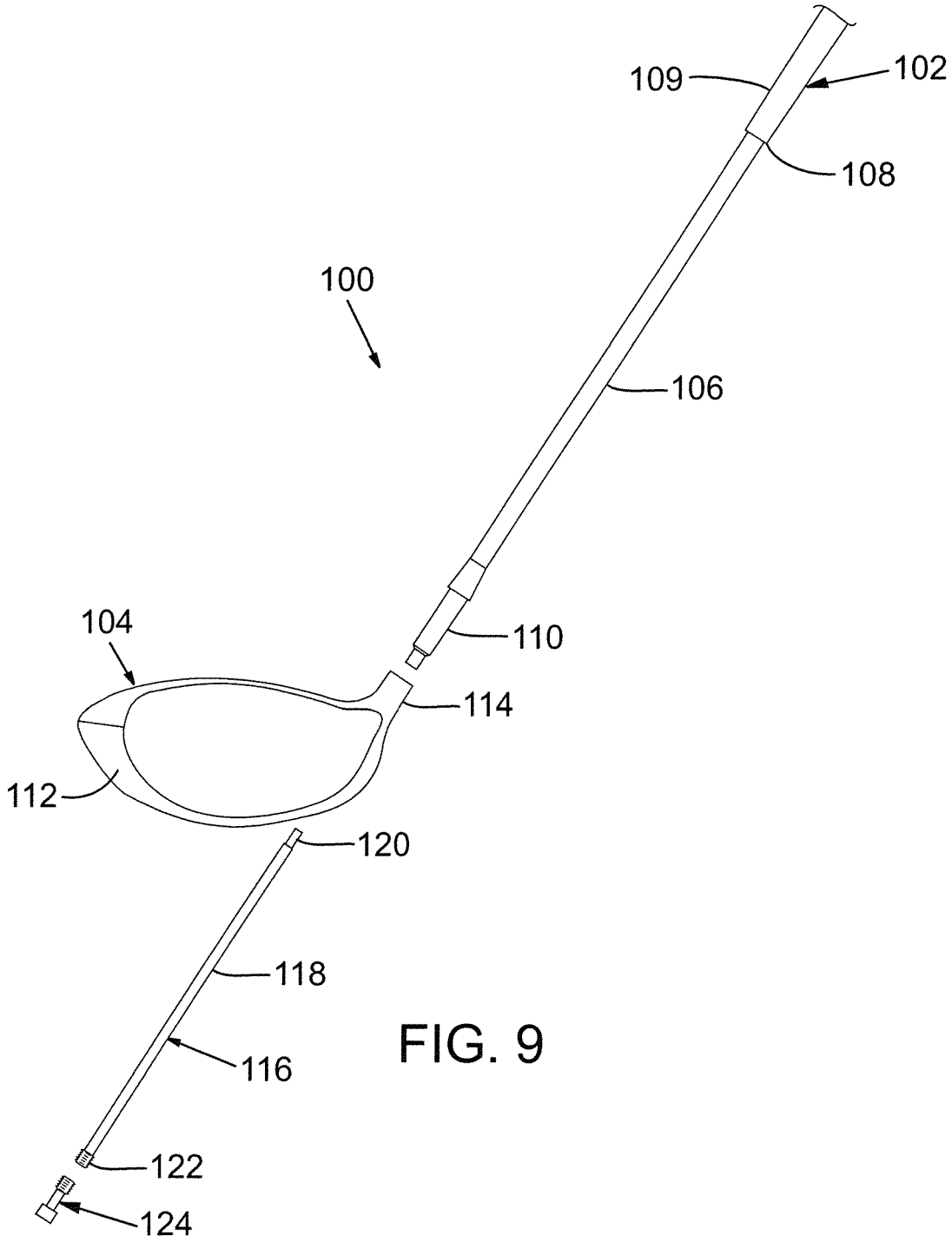
FIG. 9 is a perspective exploded view of a portion of a golf club according to the fourth embodiment, depicting the reduced-EI portion of the shaft, the clubhead, and a stiffener insert used for adding stiffness to the reduced-EI portion.
Figure 10:
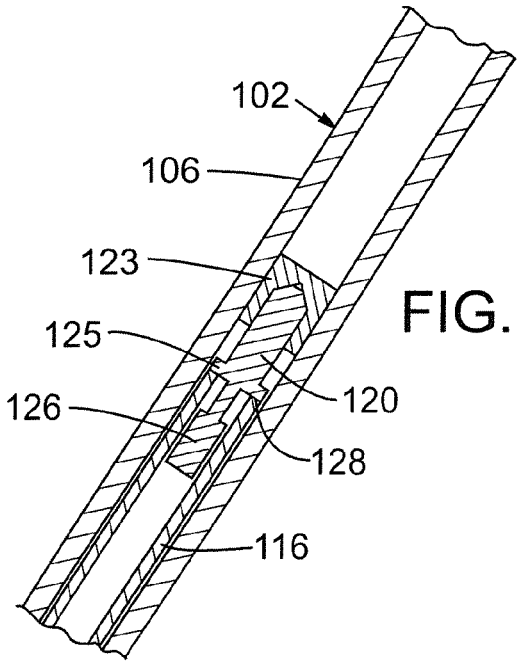
FIG. 10 is a detail cross-section of a region of the shaft of FIG. 9 near the interface of the reduced-EI portion with the remainder of the shaft, and depicting one end of the stiffener insert in place inside the reduced-EI portion.
Figure 11:
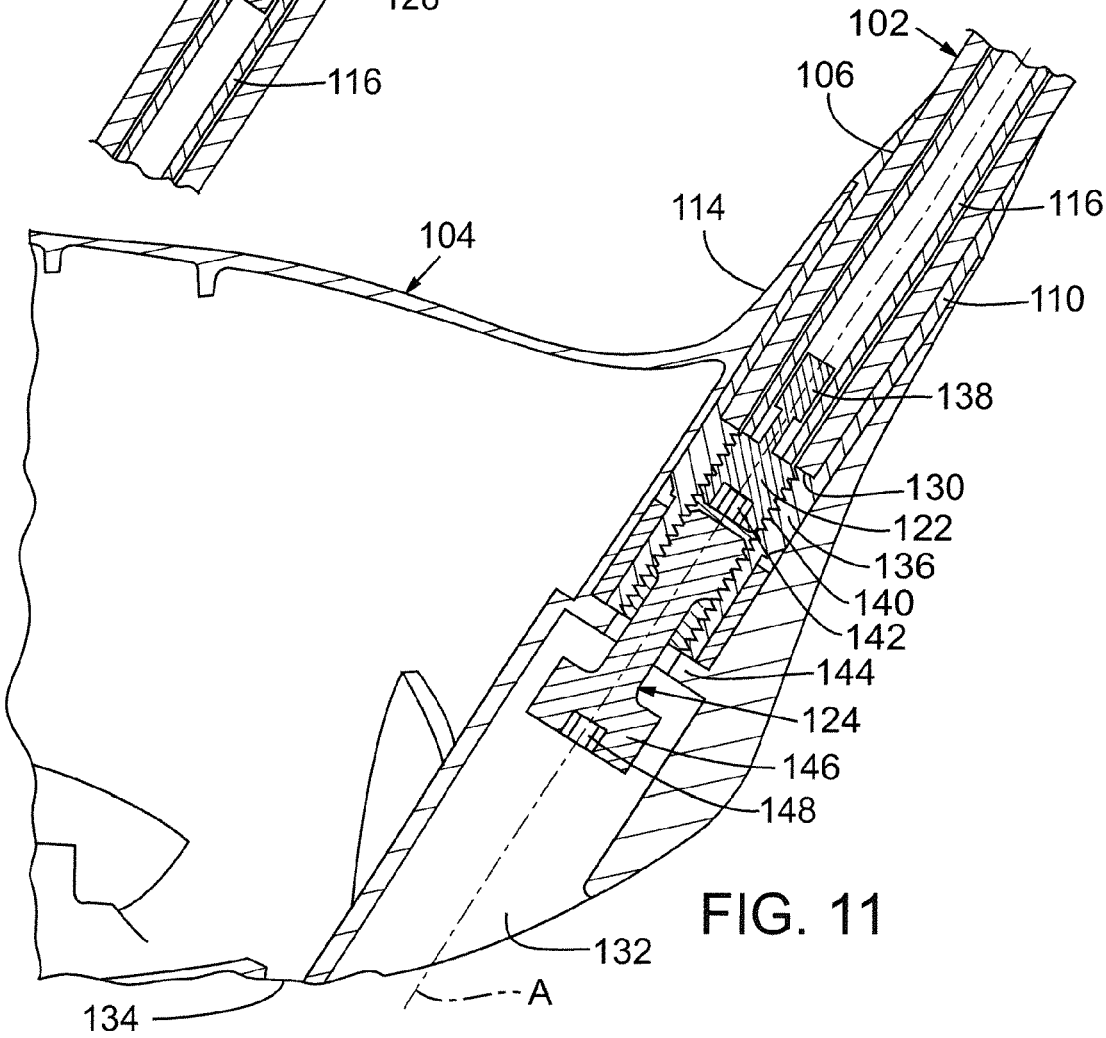
FIG. 11 is a detail cross-section of a region of the shaft of FIG. 9, including an internal stiffener, that connects to the clubhead when a detachable head/shaft system is used.

This embodiment is shown in FIGS. 9, 10, and 11. Turning first to FIG. 9, the distal portion of a golf club 100 is shown in exploded view. The golf club 100 comprises a shaft 102 and a clubhead 104. The shaft 102 includes a hollow reduced-EI portion 106 attached at an interface 108 to the remaining portion 109 of the shaft 102. The remaining portion 109 can be as described in the first embodiment, for example. The reduced-EI portion 106 terminates with an internally threaded (female threaded) ferrule sleeve 110. The clubhead 104 comprises a body 112 and a hosel 114. The ferrule sleeve 110 slip-fits into the hosel 114. The golf club 100 also comprises a stiffener insert 116 including a shaft 118, a tip 120, and a threaded end 122. As selected by the golfer, the stiffener insert 116 is inserted coaxially into the lumen of the reduced-EI portion 106 via the clubhead 104, as described below. A securing screw 124 or analogous fastener is used for affixing the clubhead 104 to the ferrule sleeve 110 and thus to the shaft 102, regardless of whether the stiffener insert 116 is used.

Turning now to FIG. 10, a portion of the reduced-EI portion 106 is shown in cutaway to reveal internal detail with the stiffener insert 116 inserted in and situated coaxially inside (in the lumen of) the reduced-EI portion to add stiffness back to the reduced-EI portion. Also located coaxially inside the reduced-EI portion 106 is a locator bushing 123 at or near the interface 108. Whenever the stiffener insert 116 is situated in the lumen of the reduced-EI portion 106, the tip 120 is inserted into the locator bushing 123 as shown to maintain coaxiality of the insert with the reduced-EI portion. Desirably, the tip 120 comprises a flange 125 and an insert portion 126, wherein the insert portion 126 extends coaxially in the lumen of the stiffener insert 116 up to the flange 125. Thus, the tip 120 is securely attached to the end 128 of the stiffener insert 116.

FIG. 11 depicts a portion of the clubhead 104, including the hosel 114, in cutaway. The tip-end 130 of the shaft 102 is inserted coaxially into the ferrule sleeve 110, and the ferrule sleeve is inserted into the hosel 114. Coaxial with the hosel 114 is a bore 132 extending to the heel 134 of the clubhead 104. The bore 132 provides an access port, at the heel 134, for insertion of the stiffener insert 116 into the lumen of the shaft 102 and for inserting the securing screw 124. Specifically, the stiffener insert 116 is inserted, tip 120 first, into the lumen of the reduced-EI portion 116 via the bore 132. The stiffener insert 116 is secured by screwing the male thread 140 of the threaded end 122 into a female thread 136 in the ferrule sleeve 110 as the tip 120 is inserted into the locator bushing 123 (FIG. 10). Desirably, the threaded end 122 comprises an insert portion 138 extending coaxially into the lumen of the stiffener insert 116 up to the male thread 140 to attach the threaded end 122 securely to the stiffener insert. The threaded end 122 is screwed into the ferrule sleeve 110 until the tip 120 is fully inserted into the locator bushing 123. To such end, the threaded end 122 desirably defines a splined socket 142 or analogous feature to facilitate use of a tool (not shown). The securing screw 124 (desirably provided with a splined socket 148 usable with the same tool) is then screwed into the female thread 136 of the ferrule sleeve 110 to attach the clubhead 104 securely to the ferrule and thus to the shaft 102. The bore 132 in the hosel 114 desirably defines a shoulder 144 against which the head 146 of the securing screw 124 is urged as the securing screw is fully screwed into the female thread 136 of the ferrule sleeve 110. Desirably, the ferrule sleeve 110 is keyed or splined or provided with an analogous alignment and anti-rotation feature (not shown) to prevent the clubhead 104 from rotating about the longitudinal axis A of the shaft 102 during use.

The insert 116 of this embodiment is an internal stiffener that extends into the shaft 102 substantially the length of the reduced-EI portion 106. As a result, at least the reduced-EI portion 106 must be hollow to receive the insert 116. The insert 116 need not be exactly the same length as the reduced-EI portion 106. The specific length of the stiffener 116, relative to the length of the reduced-EI portion 106, can be established based on, for example, the particular characteristics of the interface 108. For example, if the interface 108 comprises the portions 106, 109 coupled together end-to-end, then it may be desirable that the stiffener 116 extend slightly past the interface 108, toward the butt-end of the shaft.

The insert 116 can be made of the same material as the reduced-EI portion 106, but need not be. Candidate materials are not limited to metals. The insert 116 can be made of any workable material having sufficient durability for its intended use and providing the desired stiffness contribution. Example materials are any of the materials of which the shaft and/or reduced-EI portion can be made. The insert 116 can be hollow, as shown, or solid.

Whereas the reduced-EI portion 106 provides the shaft 102 with enhanced flexibility (reduced stiffness) over the length of the reduced-EI portion, the insert 116 adds stiffness back to the reduced-EI portion. To such end, the golf club 100 can comprise either one stiffener insert 116 (see, for example, FIG. 12) or a kit of multiple stiffener inserts that can be individually selected to provide a different contribution of added stiffness to the reduced-EI portion 106. In other words, a kit of stiffener inserts provides the golfer, using the club 100, with a range of selectable stiffness values at the tip-end region of the shaft 102. To obtain a desired stiffness, the golfer selects an appropriate stiffener insert 116 and inserts it into the shaft 102, as described above. Thus, using a golf club 100 according to this embodiment, the golfer can elect either to use the club without a stiffener 116 (and thus exploit the benefits of the lower EI of the shaft adjacent the clubhead, such as enhanced loft), or to use the club with a stiffener as described above. The stiffness contributed by the insert 116 to the reduced-EI portion 106 can be sufficient for the shaft 102 to behave as a conventional shaft (i.e., to exhibit a substantially linear plot of EI as shown in FIG. 2). Alternatively, the stiffness contributed by the insert 116 can have too low a magnitude to restore the reduced-EI portion to conventional stiffness relative to the rest of the shaft. Further alternatively, the insert 116 can contribute excess stiffness and increase the stiffness of the reduced-EI portion to greater than conventional.

The socket 148 can be, for example, a hex socket, a square socket, a Torx socket, a Philips screwdriver socket, a flat-blade screwdriver socket, or other suitable feature defined in the head 146 of the screw 124. Alternatively, the socket 148 can be omitted and the head 146 configured for engagement with a socket tool, such as a hex-socket or square-socket tool.

With this embodiment, to exchange a current stiffener insert 116 for another, the screw 124 is unscrewed from the bore 132 using a tool that engages the socket 148 in the head 146 of the screw. After removing the screw 124, the tool is inserted into the socket 142 of the current insert 116 to unscrew the insert. A new insert 116 is then inserted into the shaft via the bore 132, as described above, and screwed into place using the tool. The screw 124 is then screwed into place and the club is ready for use.

Figure 11A:
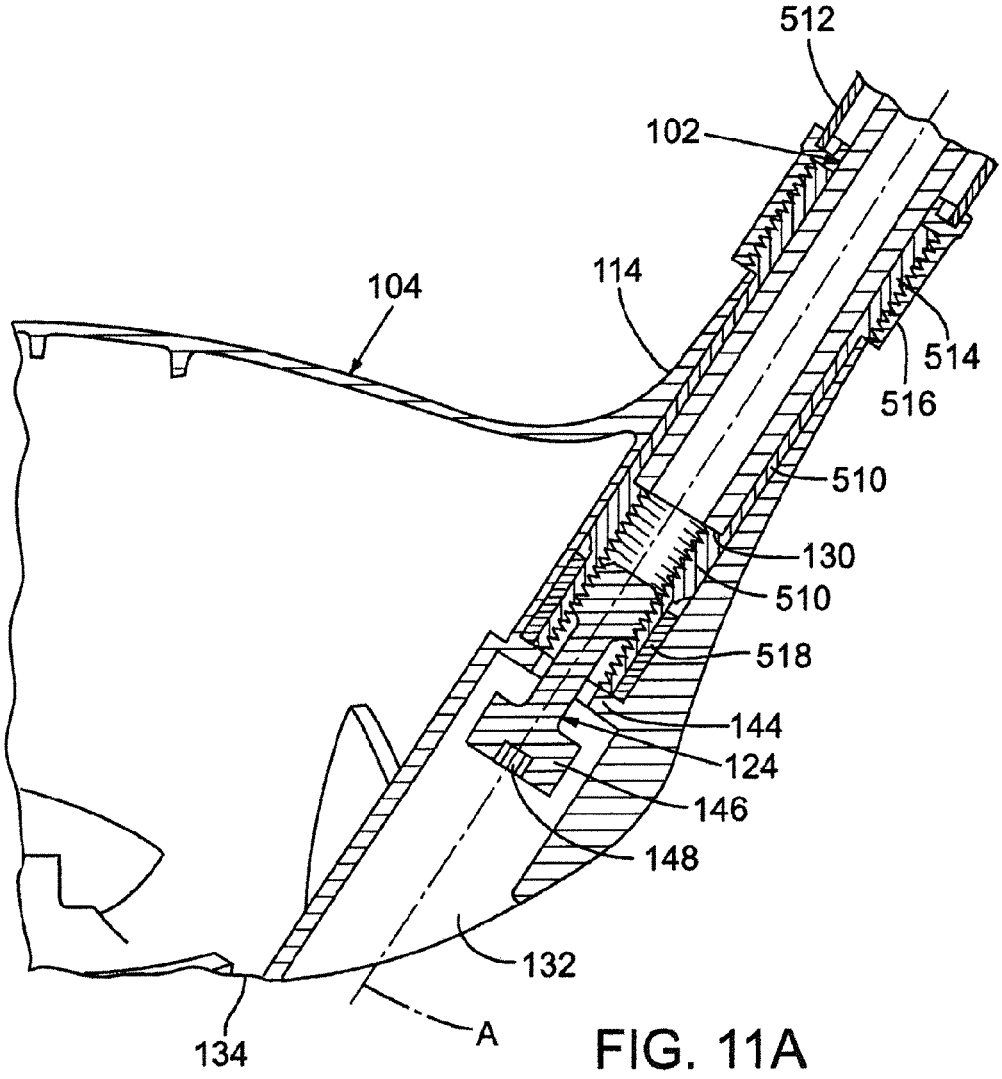
FIG. 11A is a detail cross-section of a section of a region in which a shaft with external stiffener is connected to a detachable clubhead.

FIG. 11A is similar to FIG. 11, but depicts an embodiment in which a shaft 102, to which an external stiffener 512 has been attached, is attached to a clubhead 104. A portion of the clubhead 104, including the hosel 114, is shown in cutaway. The tip-end 130 of the shaft 102 is inserted coaxially into a ferrule sleeve 510, and the ferrule sleeve is inserted into the hosel 114. Coaxial with the hosel 114 is a bore 132 extending to the heel 134 of the clubhead 104. The bore 132 provides an access port, at the heel 134, for inserting the securing screw 124. The securing screw 124 includes a head 146 and a splined socket 148, slot, or other tool receptacle used for turning the screw to secure the clubhead 104 to the shaft 102. As the screw 124 is tightened, the head 146 is urged against a shoulder 144.

Figures 12, 13:
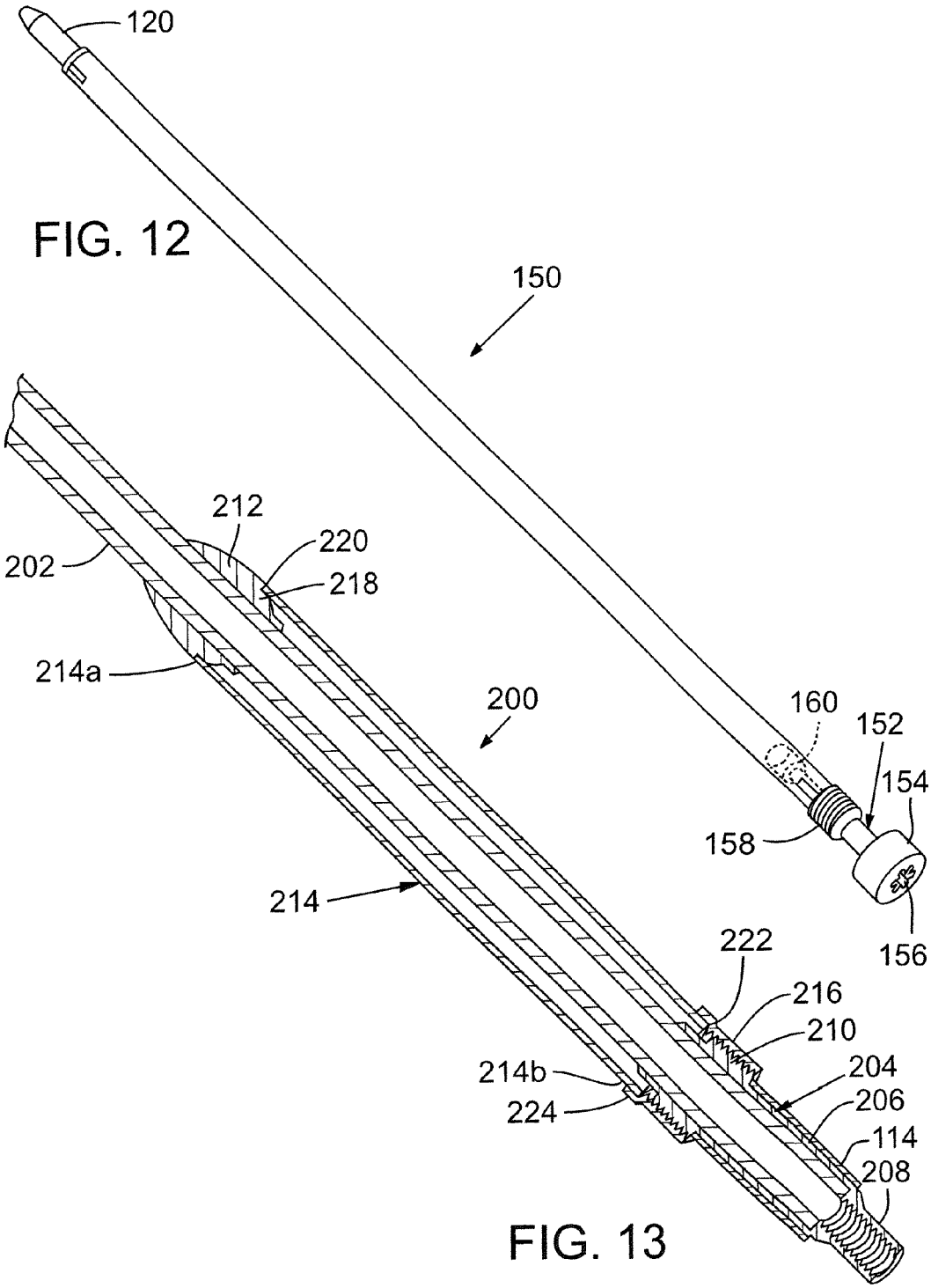
FIG. 12 is a perspective view of an alternative configuration of a stiffener used in the fourth embodiment.
FIG. 13 is a section of a region of the shaft of a golf club according to the fifth embodiment, depicting the reduced-EI portion and an external stiffener sleeve used for adding stiffness to the reduced-EI portion.

The ferrule sleeve 510 includes an external threaded portion 514 that is situated upstream of the hosel 114 and outside the shaft 102. A threaded collar 516 is attachable to the external threaded portion 514 to urge the external stiffener against a centering ferrule (see item 212 in FIG. 13) to secure the stiffener to the shaft. Further details are shown in FIG. 13. Desirably, the ferrule sleeve 510 keyed or splined.

In an alternative configuration of a stiffener insert 150, shown in FIG. 12, the securing screw 124 and the threaded end 122 are combined into a single unit screw 152 that is used both for securing the insert 150 in the shaft and for securing the shaft to the clubhead. The screw 152 in this alternative embodiment includes a head 154 with socket 156, a male thread 158, and an end 160. The end 160 is inserted into the lumen of the insert 150 as shown in FIG. 12, and the male thread 158 is screwed into the female thread 136 of the ferrule 110 (see FIG. 11). In this configuration the threaded end 122 is absent, so the male thread 158 of the screw 152 can be screwed further into the female thread 136, sufficiently to cause the head 154 of the screw to engage the shoulder 144 (FIG. 11). This configuration allows the shaft to be removed from the clubhead and the insert to be removed from the shaft in one operation.

Alternative configurations do not require that the clubhead be removable from the shaft. For example, the bore on the sole of the clubhead could allow access to the shaft, or alternatively the stiffener insert could be inserted from the butt-end of the shaft. In the latter (i.e., configuration in which the insert is inserted from the butt-end), the locator bushing desirably has a through-hole, and the tip desirably has a head or shoulder on the extreme end to match with the bushing. The threaded end can still be accessed from a bore in the sole of the clubhead or more directly if the clubhead were removable from the shaft. Alternatively, the stiffener can be threaded into place using a long tool inserted into the shaft from the butt-end, wherein the tool engages a complementary feature on the stiffener, for example.

Fifth Embodiment

Figure 14:
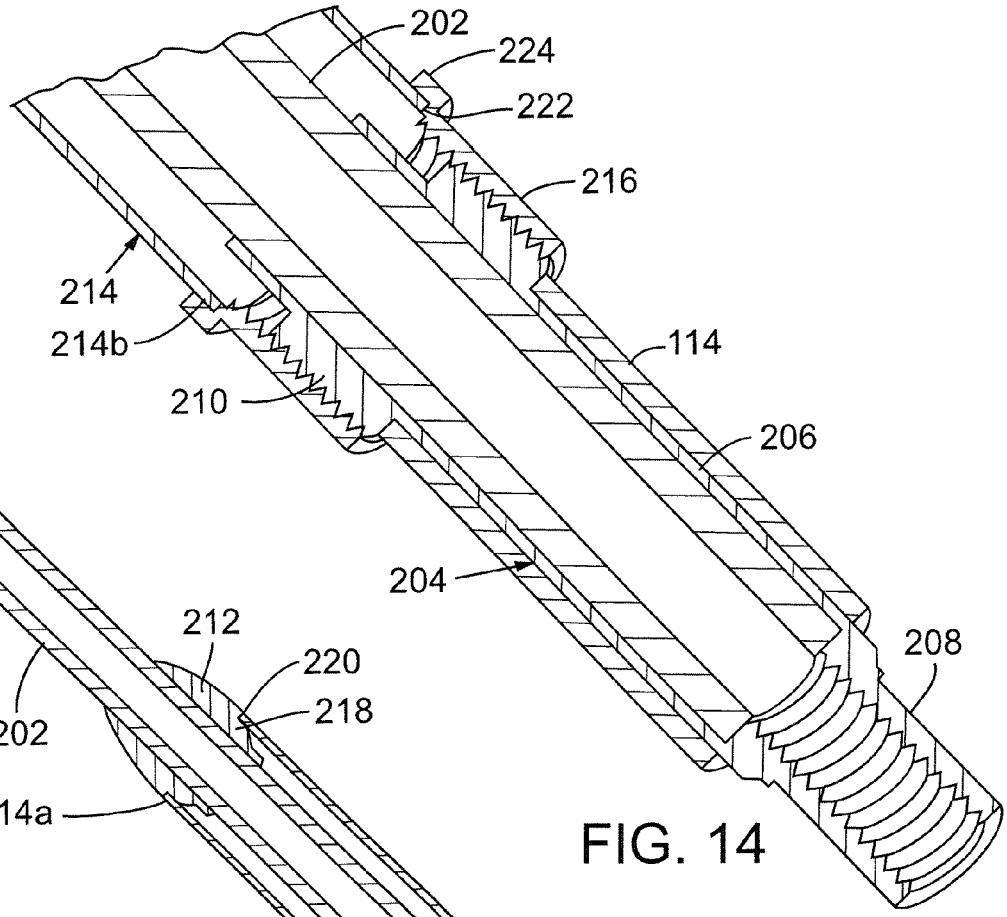
FIG. 14 is a close-up section of a portion of the region shown in FIG. 13, detailing the attachment of the external stiffener sleeve in the region of the shaft tip-end at the hosel of the clubhead.
Figure 15:
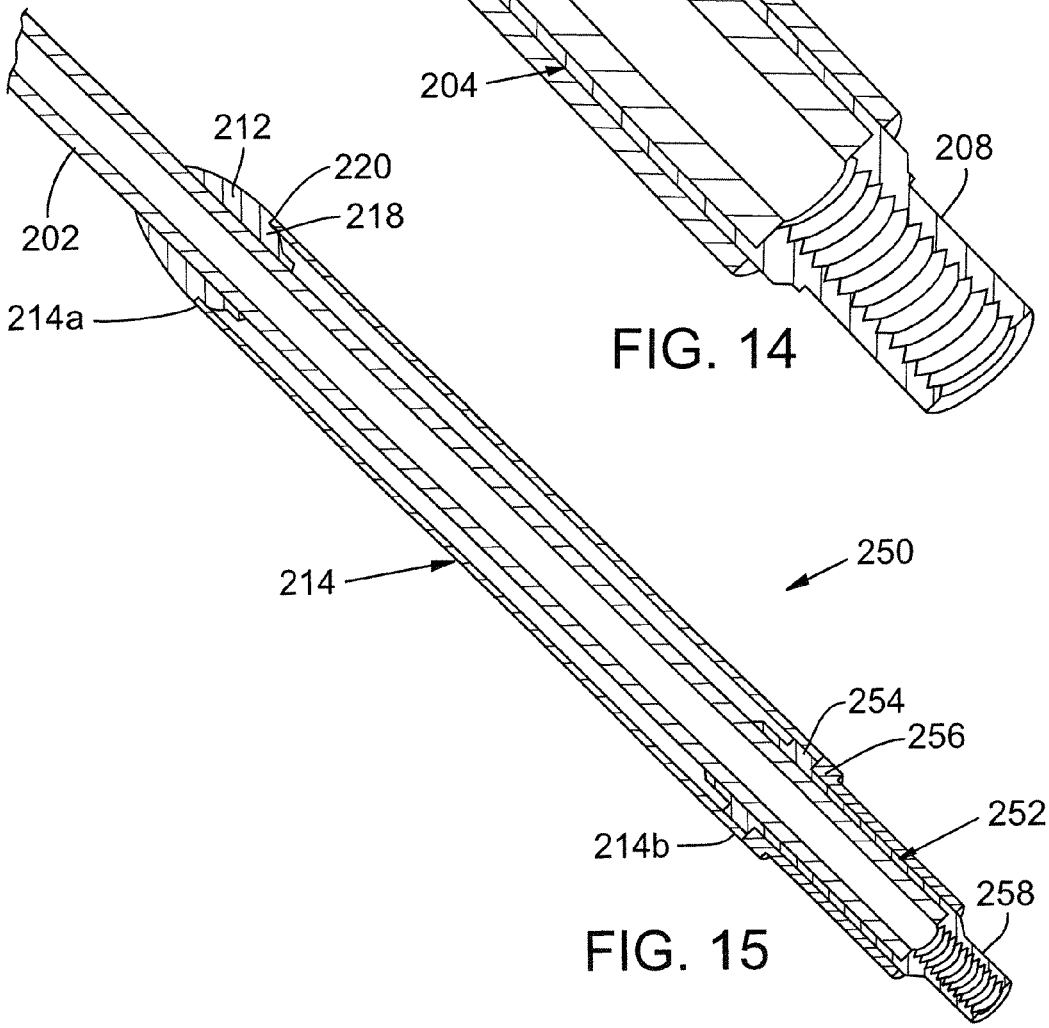
FIG. 15 is a section of a region of the shaft of a golf club according to an alternative configuration of the fifth embodiment, depicting the reduced-EI portion and the external stiffener sleeve.

In this embodiment, instead of the reduced-EI portion of the shaft being provided with an internal stiffener (stiffener "insert"), an external stiffener (stiffener "sleeve") is utilized for adding stiffness back to the reduced-EI portion. By "external" is meant that the stiffener is situated outside the shaft rather than inside the shaft. This embodiment is illustrated in FIGS. 13, 14, and 15. The shaft can be hollow or solid (see, e.g., the third embodiment).

In this embodiment the shaft 200 includes a reduced-EI portion 202 as described above. In FIG. 13, the reduced-EI portion 202 terminates with a ferrule sleeve 204. The ferrule sleeve 204 has certain features similar to the ferrule sleeve 110 in the fourth embodiment. Specifically, the ferrule sleeve 204 includes a portion 206 that is inserted into the hosel 114 of a clubhead (clubhead not shown, but see FIG. 11, for example) in the same manner as in the fourth embodiment. Also, the ferrule sleeve 204 includes a female-threaded end 208 configured to received a securing screw (not shown, but see item 152 in FIG. 12) as in the fourth embodiment. The ferrule sleeve 204 differs from the ferrule sleeve 110 by including an external threaded portion 210. Located on the outside of the shaft, at or near the interface between the reduced-EI portion and the remainder of the shaft, is a centering ferrule 212. The centering ferrule 212 desirably is bonded or otherwise permanently attached to or formed from the shaft.

The external stiffener 214 of this embodiment is configured as a hollow sleeve that is held in place by the centering ferrule 212 and by a threaded collar 216. More specifically, the centering ferrule 212 includes a leading conical portion 218 for receiving one end 214*a* of the stiffener sleeve 214. The leading conical portion 218 includes a stop 220. The threaded collar 216 includes a female thread that screws onto the external threaded portion 210 of the ferrule sleeve 204. The threaded collar 216 also includes a shoulder 222 that engages the end 214*b* of the stiffener 214 and includes a sleeve 224 having an inside diameter slightly greater than the outside diameter of the stiffener 214. The threaded collar 216 can include external flats or the like (not shown) to facilitate its attachment and detachment using a suitable tool. A close-up of details of the ferrule sleeve 204 and threaded collar 216 is shown in FIG. 14.

The stiffener sleeve 214 can be made of any suitable material, not limited to metals or composites, having sufficient durability and providing the desired stiffness contribution. For example, the stiffener sleeve 224 can be made of any material of which the shaft and/or reduced-EI portion can be made.

To attach the stiffener sleeve 214 of this embodiment, the clubhead is detached from the shaft by removing the securing screw. The sleeve 214 is then slipped over the ferrule sleeve 204 onto the reduced-EI portion 202 until the end 214*a* of the sleeve 214 fully engages the leading conical portion 218 and stop 220 of the centering ferrule 212. Then, the threaded collar 216 is screwed onto the male thread 210 of the ferrule sleeve 204 until the end 214*b* of the sleeve 214 enters the sleeve 224 and engages the shoulder 222. Thus, coaxiality of the sleeve 214 with the reduced-EI portion 202 is achieved. The ferrule sleeve 204 is reinserted into the hosel 114 and firmly attached by screwing in the securing screw. Removing the stiffener sleeve 214 (e.g., to replace it with another one in a kit thereof, to change the local stiffness of the shaft), a procedure having steps in reverse order from the above is performed.

An alternative configuration 250, shown in FIG. 15, omits the threaded collar 216 but retains the centering ferrule 212 and stiffener sleeve 214. The centering ferrule sleeve 212 engages the end 214*a* of the sleeve 214 in the manner described above. The ferrule 206 is replaced with a ferrule sleeve 252 that includes, instead of a male threaded portion 210, a shoulder 254 having an outside diameter slightly less than the inside diameter of the stiffener sleeve 214. During attachment of the sleeve 214, the end 214*b* thereof slips over the shoulder 254 and is stopped by the top edge 256 of the hosel 114 whenever the shaft is attached to the clubhead as described above. Attachment of the shaft to the clubhead is achieved using a securing screw, as described above, or analogous fastener that threads into the female threaded end 258.

In certain embodiments, both an internal and an external stiffener can be used. The stiffeners need not be the same length or made of the same material. In these and in other embodiments, a golf club can be supplied with a "kit" of stiffeners (e.g., multiple internal stiffeners, multiple external stiffeners or combinations thereof) to provide a range of add-back stiffness selectable by the golfer to address particular situations arising during play.

Certain embodiments are directed at least to the user of the club, such that adding, removing, or exchanging a stiffener can be performed by the user. Other embodiments are directed at least to the manufacturer of the club, wherein adding a stiffener is performed during manufacture of the club. The stiffener can be permanent, wherein the stiffener remains on or in the shaft without intervention by the user, or the stiffener can be semi-permanent, wherein removing or exchanging the stiffener is performed by the manufacturer or by a qualified repair person and/or performed by the user.

While the invention has been described in connection with preferred embodiments, it will be understood that it is not limited to those embodiments. On the contrary, the invention is intended to encompass all modifications, alternatives, and equivalents as may be included within the spirit and scope of the invention, as defined by the appended claims.

What is claimed is:

1. A golf club, comprising:

a shaft including a butt-end, a tip-end, a length extending from the butt-end to the tip-end, and an interface at a location along the length, the length including a major-length portion extending from the butt-end to the interface and a minor-length portion extending from the interface to the tip-end, the minor-length portion being shorter and having less stiffness than the major-length portion; and a clubhead mounted to the tip-end;

wherein the butt-end includes a grip;

the major-length portion exhibits a substantially uniform first rate of stiffness reduction with distance from the butt-end to the interface;

the minor-length portion exhibits less stiffness than the major-length portion;

the interface comprises a juncture of the major-length and minor-length portions and exhibits a rate of stiffness reduction that is greater than the first rate in a direction toward the tip-end;

the lowest stiffness in the minor-length portion is 10 $N \cdot m^2$ or higher at the tip-end;

wherein the major-length portion is made of a first material, the minor-length portion is made of a second material, and the interface comprises a junction between the first and second material;

wherein one of the first and second materials is a metal and the other of the first and second materials is a composite material; and wherein the interface is formed as a gradual transition from the first material to the second material.

2. The golf club of claim 1, wherein the minor-length portion exhibits a second rate of stiffness reduction with distance from the interface to the tip-end.

3. The golf club of claim 2, wherein the second rate is substantially uniform not equal to the first rate.

4. The golf club of claim 1, wherein the minor-length portion is no greater than eight inches in length.

5. The golf club of claim 1, wherein:

the clubhead is of a metal-wood; and the clubhead has a stated loft of 8.5 to 14 degrees.

6. The golf club of claim 1, wherein the clubhead is detachable from the tip-end.

* * * * *